US006557591B2

(12) United States Patent
Pearlstein et al.

(10) Patent No.: US 6,557,591 B2
(45) Date of Patent: May 6, 2003

(54) BULK GAS BUILT-IN PURIFIER WITH DUAL VALVE BULK CONTAINER

(75) Inventors: Ronald Martin Pearlstein, Macungie, PA (US); Benjamin Lee Hertzler, Allentown, PA (US); Lawrence Paul Jarrett, Wind Gap, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/906,987

(22) Filed: Jul. 17, 2001

(65) Prior Publication Data

US 2003/0015250 A1 Jan. 23, 2003

(51) Int. Cl.[7] ..... B65B 1/20

(52) U.S. Cl. ..... 141/11; 141/44; 141/48; 141/69; 141/91; 141/286; 55/414; 55/417; 55/426; 96/147; 96/189

(58) Field of Search ..... 141/11, 37, 44, 141/47, 48, 69, 89, 91, 285, 286; 55/312, 313, 413, 414, 417, 418, 420, 423, 426; 96/139, 140, 147, 188, 189

(56) References Cited

U.S. PATENT DOCUMENTS 1,821,549 A 9/1931 Hornor et al.
4,032,311 A * 6/1977 Bohmrich et al. ..... 128/205.29
5,133,787 A * 7/1992 Diot et al. ..... 55/476
5,409,526 A 4/1995 Zheng et al. ..... 96/132
5,980,599 A 11/1999 Chris et al. ..... 55/312

FOREIGN PATENT DOCUMENTS

EP 1037269 9/2000 ..... H01L/21/205

OTHER PUBLICATIONS

EP Search Report dated Oct. 28, 2002.

* cited by examiner

*Primary Examiner*—Timothy L. Maust
(74) *Attorney, Agent, or Firm*—Geoffrey L. Chase

(57) ABSTRACT

An apparatus for delivering a gaseous product includes a horizontal container having inlet and outlet ports, an elongated hollow tube inside the container, a purifying medium inside the tube, inlet and outlet control means adapted to control delivery of the fluid to the inlet port and to control delivery of a gaseous product from the outlet port. The tube has a first opening, a second opening spaced apart from the first opening, and an internal axis between the first and second openings. The first opening is in fluid communication with the outlet port and the second opening is in fluid communication with a vapor space in the container. A portion of the internal axis adjacent the second opening is at an angle greater than zero degrees relative to the horizontal longitudinal axis of the container. Each of the inlet and outlet control means preferably are single ported valves.

22 Claims, 1 Drawing Sheet

BULK GAS BUILT-IN PURIFIER WITH DUAL VALVE BULK CONTAINER

BACKGROUND OF THE INVENTION

The invention relates to chemical delivery systems, and in particular to an apparatus and method for delivering a purified gaseous product that is sufficiently pure for use in the electronics industry, such as for semiconductor fabrication and processing. However, the invention is not limited to those applications and may have other uses, such as in commercial processes that use high purity gas from tanks or cylinders of compressed or liquefied gas.

Semiconductor manufacturers require high-purity gases and chemicals for production processes to avoid defects in the fabrication of semiconductor devices. Typical processing steps include using cleaning solvents for initial wafer preparation, wet etching, chemical vapor deposition, and the like. The presence of very minute amounts of impurities at any one step may result in contamination of the wafer, which may result in a reduction in semiconductor device yield or having to scrap the chip.

As semiconductor feature sizes continue to shrink, increasingly greater demands are placed on the required purity of the gases and chemicals used to produce semiconductor devices. As a means to increase yields, semiconductor fabrication facilities ("fabs") commonly require process gases to meet particle specifications of less than 0.02 micron and metal specifications on the order of one part per billion or less. It is anticipated that industry standards will become more stringent in the future, as semiconductor feature sizes continue to shrink.

Electronic grades of process gases commonly have been supplied to semiconductor manufacturers in cylinders or tanks. However, as specifications regarding impurity concentrations have become more stringent, it has become more difficult to supply gases of sufficient purity for semiconductor processing. Even special preparation of the cylinders or containers by polishing and baking the inner surfaces fails to produce sufficient purity. Therefore, purifiers at the point of use often have been employed to remove contaminants and raise the purity of the gases on delivery.

Many prior art systems purify the gas after it exits the bulk container by using an external purifier. A disadvantage of this approach is that the piping between the bulk gas container and the external purifier is not protected in such systems. In addition, since the external purifier is required to withstand significant gas pressure, it can be very expensive.

Some gases are supplied in large, horizontal liquefied gas cylinders, such as "Y" cylinders. Examples include HCl, $Cl_2$, and $SF_6$. Large external purifiers are required to consistently and reliably meet the purity requirements of the processes using these gases. In addition to being expensive, these purifiers require a sizeable footprint in the facility layout.

In addition, the piping between the cylinder and purifier is not protected from the deleterious effects of moisture corrosion when moisture is present in the gas. This is particularly significant because the high pressure portions of the piping system are the most vulnerable to corrosion, since the partial pressure of moisture is the greatest at this point in a distribution system.

In attempting to address the problem, various approaches have been taken with in-tank purifiers. Although in-tank purifiers designed to remove contaminants from compressed gases or liquefied gases by high-pressure cylinders have been long known, as shown in U.S. Pat. No. 1,821,549 (Homer, et al.), problems remain and those prior art in-tank purifiers do not meet the current or future purity requirements of the electronics industry.

U.S. Pat. No. 5,409,526 (Zheng, et al.) discloses an apparatus for purifying gases delivered from vertical gas cylinders. The built-in purifier taught by Zheng, et al. works well for vertical cylinders. However, such a straight tube purifier cannot be used in horizontal liquefied gas cylinders, because the tube might become submerged below the liquid level, leading to unpredictable and potentially adverse results during product withdrawal.

Also, there are disadvantages of the valve taught by Zheng, et al., which uses a single dual ported valve for both filling and emptying the cylinder. The valve uses a single external connection and a two-way diverter valve communicates flow from the external connection to either: (a) the cylinder filling port, or (b) the gas withdrawal port. One disadvantage is that a customer or user must have a dual port valve. In addition to being costly, the availability of these valves is limited at times.

U.S. Pat. No. 5,980,599 (Chris, et al.) discloses an in-tank purifier using a displacable purifier body. The arrangement of this purifier also is limited to use in vertical cylinders, and the purifier would have similar problems with horizontal liquefied gas cylinders as discussed above for the built-in purifier of Zheng, et al.

It is desired to have an apparatus and method for delivering a purified gaseous product from a horizontal container having a built-in purifier, especially a gaseous product that may be used in the fabrication of semiconductor devices.

It is further desired to have an apparatus and method for delivering a purified gaseous product from a horizontal container having a built-in purifier that meets stringent purity requirements, such as the requirements for semiconductor manufacturing processes.

It is still further desired to have a more reliable apparatus and method for delivering a high-purity gaseous product for use in the electronics industry, such as for semiconductor manufacturing processes, from a horizontal container using single ported valves to fill the container with fluid and to withdraw the gaseous product.

It also is desired to have an apparatus and method for delivering high-purity gaseous products which overcome the difficulties and disadvantages of the prior art to provide better and more advantageous results.

BRIEF SUMMARY OF THE INVENTION

The invention is an apparatus and a method for delivering a purified gaseous product. There are several embodiments and variations of the apparatus and the method.

A first embodiment of the apparatus includes four elements. The first element is a substantially horizontal container adapted to contain a supply of a fluid. The container has a substantially horizontal longitudinal axis, at least one inner wall, a first end, a second end opposite the first end, an outlet port adjacent the first end, an inlet port spaced apart from the outlet port, and an open interior for containing the fluid between the at least one inner wall and the first and second ends. At least part of the open interior is a vapor space. The second element is an elongated hollow tube disposed in the open interior of the horizontal container. The elongated hollow tube has a first opening, a second opening spaced apart from the first opening, and an internal axis between the first and second openings. The first opening is in fluid communication with the outlet port and the second opening is in fluid communication with the vapor space. A portion of the internal axis adjacent the second opening is at an angle greater than zero degrees relative to the substantially horizontal longitudinal axis. The third element is a purifying medium disposed in at least a portion of the hollow tube between the first opening and the second opening. The fourth element is an inlet control means in fluid communication with the inlet port and adapted to control delivery of the fluid to the inlet port. The fifth element is an outlet control means in fluid communication with the outlet port and adapted to control delivery of the gaseous product from the outlet port.

There are several variations of the first embodiment of the apparatus. In one variation, the gaseous product is used in the fabrication of a semiconductor device. In another variation, the fluid is selected from a group consisting of a compressed gas, a liquefied compressed gas, and a supercritical fluid. In yet another variation, the purifying medium comprises at least one layer of a material selected from a group consisting of at least one catalyst, at least one adsorbent, and at least one mixture thereof. In still another variation, the angle is about 45 degrees (45°). In yet still another variation, the inlet control means comprises at least one single ported valve and the outlet control means comprises at least one single ported valve.

There also are alternate embodiments of the apparatus. Several of these embodiments are similar to the first embodiment of the apparatus but include an additional element or feature. For example, a second embodiment of the apparatus includes a first filter disposed in the vapor space and in fluid communication with the second opening. A third embodiment of the apparatus includes a second filter adjacent the first opening and in fluid communication with the elongated hollow tube.

A fourth embodiment is an apparatus for delivering a purified gaseous product to be used in the fabrication of a semiconductor device. The apparatus of this embodiment includes seven elements. The first element is a substantially horizontal container having a substantially cylindrical shape adapted to contain a supply of a liquid having a substantially horizontal liquid surface. The container has a substantially longitudinal axis, an inner wall, an outer wall, a first end, a second end opposite the first end, an outlet port adjacent the first end, an inlet port spaced apart from the outlet port, and an open interior for containing the liquid between the inner wall and the first and second ends. At least part of the open interior is a vapor space above the liquid surface. The second element is an elongated hollow tube disposed in the open interior of the horizontal container. The elongated hollow tube has a first opening and a second opening spaced apart from the first opening. The first opening is in fluid communication with the outlet port and the second opening is in fluid communication with the vapor space. A first portion of the tube proximate the first opening is substantially parallel to the substantially horizontal longitudinal axis. A second portion of the tube distal the first opening is at an angle greater than zero degrees relative to the substantially horizontal longitudinal axis. A third element is a purifying medium disposed in at least a portion of the elongated hollow tube between the first opening and the second opening. The purifying medium comprises at least one layer of a material selected from a group consisting of at least one catalyst, at least one adsorbent, and at least one mixture thereof. The fourth element is a first filter disposed in the vapor space and in fluid communication with the second opening. The fifth element is a second filter adjacent the first opening and in fluid communication with the elongated hollow tube. The sixth element is a first single ported valve in fluid communication with the inlet port and adapted to control delivery of a source of the liquid to the inlet port. The seventh element is a second single ported valve in fluid communication with the outlet port and adapted to control delivery of the gaseous product from the outlet port.

A fifth embodiment of the apparatus is similar to the fourth embodiment but includes a visually observable index on the outer wall of the container and/or on an outer surface of at least one of the first and second single ported valves. The index designates a desired positioning of the container in a predetermined desired position. When the container is positioned approximately in the predetermined desired position, the second opening is located in the vapor space. Preferably, the desired positioning provides for a perpendicular distance between the substantially horizontal liquid surface and the second opening at or substantially near a maximum perpendicular distance obtainable between the liquid surface and the second opening.

As with the apparatus, there are several embodiments and variations of the method for delivering a purified gaseous product. The first embodiment of the method includes multiple steps. The first step is to provide a substantially horizontal container adapted to contain a supply of the fluid. The container has a substantially horizontal longitudinal axis, at least one inner wall, a first end, a second end opposite the first end, an outlet port adjacent the first end, an inlet port spaced apart from the outlet port, and an open interior for containing the fluid between the at least one inner wall and the first and second ends. At least part of the open interior is a vapor. The second step is to provide an elongated hollow tube disposed in the open interior of the horizontal container. The elongated hollow tube has a first opening, a second opening spaced apart from the first opening, and an internal axis between the first and second openings. The first opening is in fluid communication with the outlet port and the second opening is in fluid communication with the vapor space. A portion of the internal axis adjacent the second opening is at an angle greater than zero degrees relative to the substantially horizontal longitudinal axis. The third step is to provide a purifying medium disposed in at least a portion of the elongated hollow tube between the first opening and the second opening. The fourth step is to introduce a stream of the fluid into the inlet port. The fifth step is to withdraw a stream of the purified gaseous product from the outlet port.

There are several variations of the first embodiment of the method. In one variation, the gaseous product is used in the fabrication of a semiconductor device. In another variation, the fluid is selected from a group consisting of a compressed gas, a liquefied compressed gas, and a supercritical fluid. In yet another variation, the purifying medium includes at least one layer of a material selected from a group consisting of at least one catalyst, at least one adsorbent, and at least one mixture thereof. In still another variation, the angle is about 45 degrees (45°). In yet still another variation, the inlet control means includes at least one single ported valve and the outlet control means includes at least one single ported valve.

There also are several alternate embodiments of the method. Several of these embodiments are similar to the first embodiment of the method but include at least one additional step. For example, a second embodiment of the method includes the additional step of providing a first filter disposed in the vapor space and in fluid communication with the second opening. A third embodiment of the method includes the additional step of providing a second filter adjacent the first opening and in fluid communication with the elongated hollow tube.

In a fourth embodiment of the method the gaseous product is used in the fabrication of a semiconductor device and the method includes multiple steps. The first step is to provide a substantially horizontal container having a substantially cylindrical shape adapted to contain a supply of a liquid having a substantially horizontal liquid surface. The container has a substantially horizontal longitudinal axis, an inner wall, an outer wall, a first end, a second end opposite the first end, an outlet port adjacent the first end, an inlet port spaced apart from the outlet port, and an open interior for containing the liquid between the inner wall and the first and second ends. At least part of the open interior is a vapor space above the liquid surface. The second step is to provide an elongated hollow tube disposed in the open interior of the horizontal container. The elongated tube has a first opening, a second opening spaced apart from the first opening, and an internal axis between the first and second openings. The first opening is in fluid communication with the outlet port and the second opening is in fluid communication with the vapor space. A first portion of the tube proximate the first opening is substantially parallel to the substantially horizontal longitudinal axis. A second portion of the tube distal the first opening is at an angle greater than zero degrees relative to the substantially horizontal longitudinal axis. The third step is to provide a purifying medium disposed in at least a portion of the elongated hollow tube between the first opening and the second opening. The purifying medium includes at least one layer of material selected from a group consisting of at least one catalyst, at least one adsorbent, and at least one mixture thereof. The fourth step is to provide a first filter disposed in the vapor space and in fluid communication with the second opening. The fifth step is to provide a second filter adjacent the first opening and in fluid communication with the elongated hollow tube. The sixth step is to introduce a stream of a source of the liquid into the inlet port. (The source of the liquid may be gaseous, liquid, a two-phase fluid, or any combination thereof.) The seventh step is to withdraw a stream of the purified gaseous product from the outlet port.

A fifth embodiment of the method is similar to the fourth embodiment but includes an additional step. The additional step is to provide a visually observable index on the outer wall of the container and/or on an outer surface of at least one of the first and second single ported valves. The index designates a desired positioning of the container in a predetermined desired position. When the container is positioned approximately in the predetermined desired position, the second opening is located in the vapor space. Preferably, the desired positioning provides for a perpendicular distance between the substantially horizontal liquid surface and the second opening at or substantially near a maximum perpendicular distance obtainable between the liquid surface and the second opening.

BRIEF DESCRIPTION OF SEVERAL VIEWS OF THE DRAWINGS

The invention will be described by way of example with reference to the accompanying drawing, in which.

DETAILED DESCRIPTION OF THE INVENTION

Figure 1:
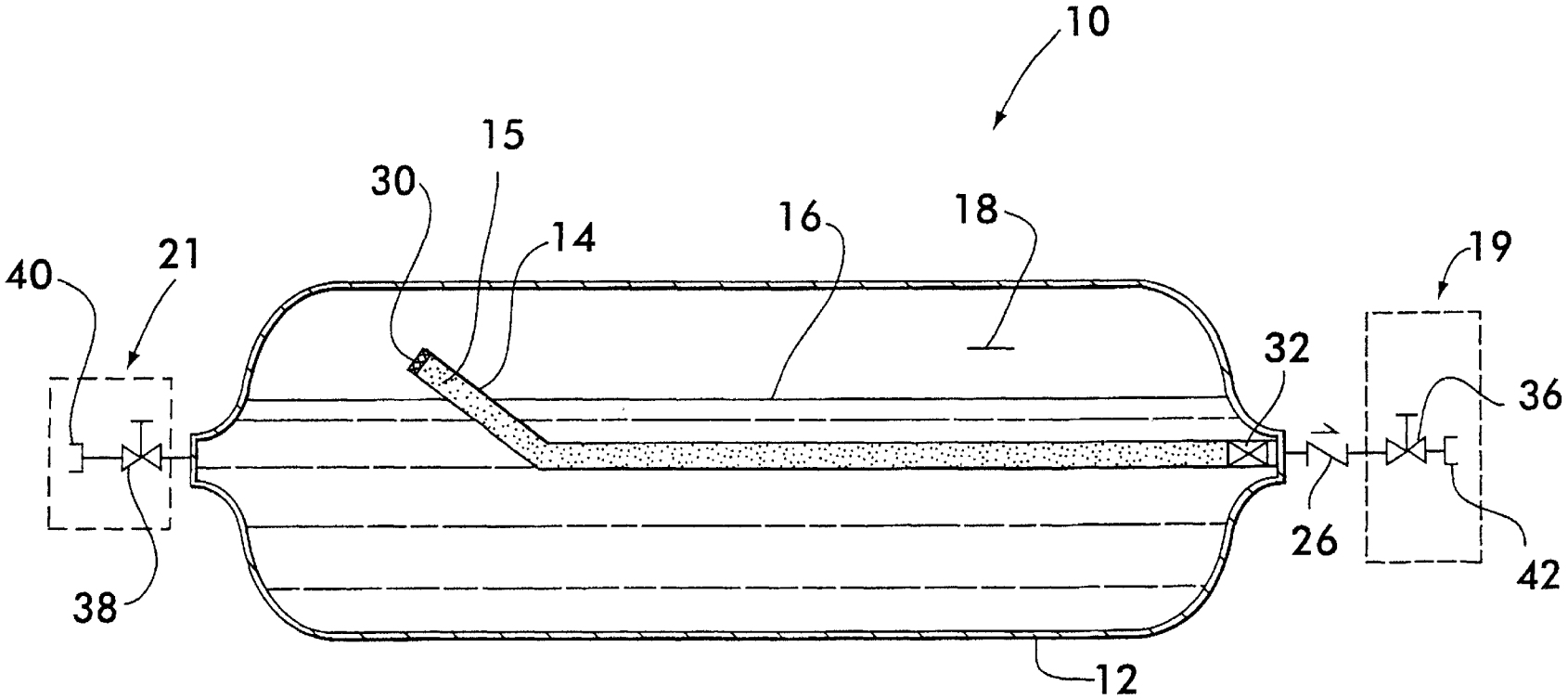
FIG. 1 is a schematic illustration of one embodiment of the invention.

The invention is an apparatus 10 and a method for delivering a purified gaseous product from a horizontal container 12, such as the horizontal cylinder shown in FIG. 1, using a single ported valve. This is done by using a separate valve 38 to fill the horizontal container and a separate valve 36 to withdraw the purified gaseous product, as shown in FIG. 1. The present invention includes improvements to the built-in purifier invention discussed in a patent application being filed concurrently with this application which is entitled "Built-In Purifier for Horizontal Liquified Gas Cylinders", U.S. patent application Ser. No. 09/906,989 (Air Products and Chemicals, Inc.'s, which patent application is incorporated herein by reference. In addition to the differences in valve arrangement and types of valves (e.g., single ported valves versus dual ported valves or other types of valves), there are other distinct differences between the two inventions, which differences will be appreciated by persons skilled in the art upon review of the discussions and drawings in both applications.

Referring to FIG. 1, the present invention utilizes a built-in purifier tube 14 located inside a horizontal container 12, such as the horizontal cylinder shown. The purifying medium (or media) 15 may be catalyst or adsorbent based or some combination thereof, including multiple adsorbents and catalysts. If multiple adsorbents or catalysts are used, these may be homogeneously mixed or may be deposited in multiple layers of different purification media within the tube. The built-in purifier is designed such that the fluid in the container may be a compressed gas, a liquefied compressed gas, or a supercritical fluid.

When the fluid is a liquefied compressed gas, the built-in purifier tube 14 is configured so that it does not act as a siphon to remove liquid rather than vapor. To avoid such a siphoning effect, the tube is oriented so that the tube inlet extends above the liquid level 16 so that the open tube inlet communicates only with the vapor space 18 above the liquid level. In a preferred embodiment, the tube bends upward at about a 45 degree angle and terminates within about 1 inch of the inner wall of the container 12.

As a result of bending the tube 14 at an angle, it has at least two portions. For example, it may have a first portion parallel to the horizontal longitudinal axis of the container and a second portion at an angle to the horizontal longitudinal axis of the container, the angle being greater than zero degrees, and preferably about 45°.

Preferably each portion of the tube has a substantially uniform shape that is substantially symmetrical about an "internal axis" corresponding to a center line of each portion of the tube. However, persons skilled in the art will recognize that other arrangements are possible. For example, the tube could be bent in more than one location, resulting in more than two portions. Also, the tube need not be substantially uniform nor substantially symmetrical about an "internal axis," in which case the internal axis would be a continuous imaginary line ("axis") inside the tube running from one end of the tube to the other end but would not correspond to a single center line (but rather would vary throughout the tube). Persons skilled in the art also will recognize that the container need not have a uniform shape symmetrical about the horizontal longitudinal axis of the container, although such a shape is preferable in a preferred embodiment.

The primary function of the purifier tube 14 is to extract product vapor from the vapor space 18 and to keep liquid from entering the gas stream. In a preferred embodiment, the tube is welded to a bull plug (not shown) into which the outlet valve 36 is threaded.

Referring again to FIG. 1, fluid enters one end of the container 12 through an inlet port where the fluid flow is controlled by inlet valve 38 in inlet valve assembly 21, which also include connection 40. A filter 30 is located at the inlet of the purifier tube 14. The filter acts as a hold down screen to contain the purifying medium 15 and as a rudimentary demister pad to avoid gross or excessive exposure of the purifying medium to the liquid due to splashing of the liquid during transportation and handling. A second filter 32 at the outlet of the purifier tube is included to remove any particles from the gas leaving the purifying medium. Purified gaseous product is withdrawn from an outlet port of the container 12 from which the product flow is controlled by outlet valve 36.

In a preferred embodiment, the container 12 is a cylindrical vessel. However, persons skilled in the art will recognize that the container may have a shape other than cylindrical. The container and/or one or both of the valves (36, 38) may be indexed by some type of marking (e.g., coloring, an arrow, an indentation) or other means so that an operator preferably will place the container in a position to ensure that the tube inlet and filter 30 of the purifier tube 14 always are oriented so that the tube inlet is above the liquid level 16.

The built-in purifier removes impurities drawn into the tube 14 from the vapor space 18. It may remove single or multiple impurities, unwanted elements or compounds that could be present in the incoming fluid, or impurities contributed by the container 12 or the filling method and apparatus. The purifying medium 15 has an end life, but may be regenerated or replaced, depending upon its composition and the particular application.

The purifying medium 15 is a material that selectively removes impurities from the gas product. The purifying medium may be made from various materials and may be arranged as a multiple material assembly by layering or mixing depending upon the gas product and the desired impurities to be removed. Its particle size also will vary depending upon the substrate requirement and gas product application.

After the vapor withdrawn from the vapor space 18 passes through the screen 30, it then passes through a frit (not shown), which is retained by a snap ring (not shown) and enters the purifying medium 15 for removal of unwanted impurities. The vapor withdrawn from the vapor space may contain impurities at a concentration in the low parts per million that will be reduced to the low parts per billion or a non-detectable level after encountering the purifying medium. A compression element (not shown) applies a slight mechanical force on the purifying medium to minimize fluidization during high flow events and settling during transportation. The frit serves to retain the purifying medium in the tube 14.

After passing through the purifying medium 15, the vapor encounters the second filter 32, which retains the purifying medium at the outlet end of the tube 14 and filters the gaseous product before it reaches the outlet valve 36 for delivery to a gas distribution system (not shown) via connection 42.

An optional check valve 26 upstream of the outlet valve 36 prevents reverse flow through the built-in purifier. If desired, the check valve may be included with the outlet valve assembly 19.

By using a single ported valve for the outlet valve 36, the size of tube 14 may be larger than the possible size if a dual ported valve was used. As a result, a greater amount of purifying medium 15 may be used in the tube. In addition, a larger diameter tube increases the allowable cantilever moment of the tube, thereby allowing for a longer purifying tube. The dual impact of a larger tube diameter plus a longer tube length can lead to significantly larger bed volume, and therefore a longer lifetime of the purifier bed.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed as:

1. An apparatus for delivering a purified gaseous product, comprising:

a substantially horizontal container adapted to contain a supply of a fluid, said container having a substantially horizontal longitudinal axis, at least one inner wall, a first end, a second end opposite said first end, an outlet port adjacent said first end, an inlet port spaced apart from said outlet port, and an open interior for containing said fluid between said at least one inner wall and said first and second ends, at least part of said open interior being a vapor space;

an elongated hollow tube disposed in said open interior of said horizontal container, said elongated hollow tube having a first opening, a second opening spaced apart from said first opening, and an internal axis between the first and second openings, said first opening being in fluid communication with said outlet port and said second opening being in fluid communication with said vapor space, wherein a portion of said internal axis adjacent said second opening is at an angle greater than zero degrees relative to said substantially horizontal longitudinal axis;

a purifying medium disposed in at least a portion of said elongated hollow tube between said first opening and said second opening;

inlet control means in fluid communication with said inlet port and adapted to control delivery of said fluid to said inlet port; and outlet control means in fluid communication with said outlet port and adapted to control delivery of said gaseous product from said outlet port.

2. An apparatus as in claim 1, wherein said purifying medium comprises at least one layer of a material selected from a group consisting of at least one catalyst, at least one adsorbent, and at least one mixture thereof.

3. An apparatus as in claim 1, wherein said fluid is selected from a group consisting of a compressed gas, a liquefied compressed gas, and a supercritical fluid.

4. An apparatus as in claim 1, wherein said angle is about 45 degrees (45°).

5. An apparatus as in claim 1, further comprising a first filter disposed in said vapor space and in fluid communication with said second opening.

6. An apparatus as in claim 5, further comprising a second filter adjacent said first opening and in fluid communication with said elongated hollow tube.

7. An apparatus as in claim 1, wherein said inlet control means comprises at least one single ported valve and said outlet control means comprises at least one single ported valve.

8. An apparatus as in claim 1, wherein said gaseous product is used, in the fabrication of a semiconductor device.

9. An apparatus for delivering a purified gaseous product to be used in the fabrication of a semiconductor device, comprising:

a substantially horizontal container having a substantially cylindrical shape adapted to contain a supply of a liquid having a substantially horizontal liquid surface, said container having a substantially horizontal longitudinal axis, an inner wall, an outer wall, a first end, a second end opposite said first end, an outlet port adjacent said first end, an inlet port spaced apart from said outlet port, and an open interior for containing said liquid between said inner wall and said first and second ends, at least part of said open interior being a vapor space above said liquid surface;

an elongated hollow tube disposed in said open interior of said horizontal container, said elongated hollow tube having a first opening, a second opening spaced apart from said first opening, said first opening being in fluid communication with said outlet port and said second opening being in fluid communication with said vapor space, wherein a first portion of said tube proximate said first opening is substantially parallel to said substantially horizontal longitudinal axis and a second portion of said tube distal said first opening is at an angle greater than zero degrees relative to said substantially horizontal longitudinal axis;

a purifying medium disposed in at least a portion of said elongated hollow tube between said first opening and said second opening, wherein said purifying medium comprises at least one layer of a material selected from a group consisting of at least one catalyst, at least one adsorbent, and at least one mixture thereof;

a first filter disposed in said vapor space and in fluid communication with said second opening;

a second filter adjacent said first opening and in fluid communication with said elongated hollow tube;

a first single ported valve in fluid communication with said inlet port and adapted to control delivery of a source of said liquid to said inlet port; and a second single ported valve in fluid communication with said outlet port and adapted to control delivery of said gaseous product from said outlet port.

10. An apparatus as in claim 9, further comprising a visually observable index on said outer wall of said container or on an outer surface of at least one of said first and second single ported valves, said index designating a desired positioning of said container in a predetermined desired position, whereby said second opening is located in said vapor space when said container is positioned approximately in said predetermined desired position.

11. An apparatus as in claim 10, wherein said desired positioning provides for a perpendicular distance between said substantially horizontal liquid surface and said second opening at or substantially near a maximum perpendicular distance obtainable between said liquid surface and said second opening.

12. A method for delivering a purified gaseous product, comprising the steps of:

providing a substantially horizontal container adapted to contain a supply of a fluid, said container having a substantially horizontal longitudinal axis, at least one inner wall, a first end, a second end opposite said first end, an outlet port adjacent said first end, an inlet port spaced apart from said outlet port, and an open interior for containing said fluid between said at least one inner wall and said first and second ends, at least part of said open interior being a vapor space;

providing an elongated hollow tube disposed in said open interior of said horizontal container, said elongated hollow tube having a first opening, a second opening spaced apart from said first opening, and an internal axis between the first and second openings, said first opening being in fluid communication with said outlet port and said second opening being in fluid communication with said vapor space, wherein a portion of said internal axis adjacent said second opening is at an angle greater than zero degrees relative to said substantially horizontal longitudinal axis;

providing a purifying medium disposed in at least a portion of said elongated hollow tube between said first opening and said second opening; introducing a stream of said fluid into said inlet port; and withdrawing a stream of said purified gaseous product from said outlet port.

13. A method as in claim 12, wherein said purifying medium comprises at least one layer of a material selected from a group consisting of at least one catalyst, at least one adsorbent, and at least one mixture thereof.

14. A method as in claim 12, wherein said fluid is selected from a group consisting of a compressed gas, a liquefied compressed gas, and a supercritical fluid.

15. A method as in claim 12, wherein said angle is about 45 degrees (45°).

16. A method as in claim 12, comprising the further step of providing a first filter disposed in said vapor space and in fluid communication with said second opening.

17. A method as in claim 16, comprising the further step of providing a second filter adjacent said first opening and in fluid communication with said elongated hollow tube.

18. A method as in claim 12, wherein said inlet control means comprises at least one single ported valve and said outlet control means comprises at least one single ported valve.

19. A method as in claim 12, wherein said gaseous product is used in the fabrication of a semiconductor device.

20. A method for delivering a purified gaseous product to be used in the fabrication of a semiconductor device, comprising the steps of:

providing a substantially horizontal container having a substantially cylindrical shape adapted to contain a supply of a liquid having a substantially horizontal liquid surface, said container having a substantially horizontal longitudinal axis, an inner wall, an outer wall, a first end, a second end opposite said first end, an outlet port adjacent said first end, an inlet port spaced apart from said outlet port, and an open interior for containing said liquid between said inner wall and said first and second ends, at least part of said open interior being a vapor space above said liquid surface;

providing an elongated hollow tube disposed in said open interior of said horizontal container, said elongated hollow tube having a first opening, a second opening spaced apart from said first opening, and an internal axis between the first and second openings, said first opening being in fluid communication with said outlet port and said second opening being in fluid communication with said vapor space, wherein a first portion of said tube proximate said first opening is substantially parallel to said substantially horizontal longitudinal axis and a second portion of said tube distal said first opening is at an angle greater than zero degrees relative to said substantially horizontal longitudinal axis;

providing a purifying medium disposed in at least a portion of said elongated hollow tube between said first opening and said second opening, wherein said purifying medium comprises at least one layer of material selected from a group consisting of at least one catalyst, at least one adsorbent, and at least one mixture thereof;

providing a first filter disposed in said vapor space and in fluid communication with said second opening;

providing a second filter adjacent said first opening and in fluid communication with said elongated hollow tube;

introducing a stream of a source of said liquid into said inlet port; and withdrawing a stream of said purified gaseous product from said outlet port.

21. A method as in claim 20, comprising the further step of providing a visually observable index on said outer wall or on an outer surface of at least one of said first and second single ported valves, said index designating a desired positioning of said container in a predetermined desired position, whereby said second opening is located in said vapor space when said container is positioned approximately in said predetermined desired position.

22. A method as in claim 21, wherein said desired positioning provides for a perpendicular distance between said substantially horizontal liquid surface and said second opening at or substantially near a maximum perpendicular distance obtainable between said liquid surface and said second opening.

* * * * *